US008337256B1

(12) United States Patent
Lin

(10) Patent No.: US 8,337,256 B1
(45) Date of Patent: Dec. 25, 2012

(54) POGO-PIN CONNECTOR

(75) Inventor: Jui-Pin Lin, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/218,454

(22) Filed: Aug. 26, 2011

(51) Int. Cl.
*H01R 13/24* (2006.01)

(52) U.S. Cl. ..... 439/700

(58) Field of Classification Search ..... 439/700, 439/66, 246, 500
See application file for complete search history.

(56) References Cited

U.S. PATENT DOCUMENTS 7,713,095 B2 * 5/2010 Yodogawa ..... 439/700
7,717,756 B1 * 5/2010 Yin et al. ..... 439/700
7,789,719 B1 * 9/2010 Yin et al. ..... 439/824
7,815,474 B1 * 10/2010 Lin et al. ..... 439/700
7,914,348 B1 * 3/2011 Lin ..... 439/700

* cited by examiner

*Primary Examiner* — Neil Abrams
*Assistant Examiner* — Phuongchi Nguyen
(74) *Attorney, Agent, or Firm* — Cheng-Ju Chiang

(57) ABSTRACT

Disclosed is a pogo-pin connector which includes an insulated body, at least one pogo-pin terminal, at least one insulative sleeve, at least one conductive terminal, at least one receiving pedestal and at least one spring part. A pogo-pin terminal slot and a conductive terminal slot are defined through insulated body. Each of the pogo-pin terminals has a top end movably protruded beyond the pogo-pin terminal slot and a bottom end defining a slotted hole toward an inside of the pogo-pin terminal. The insulative sleeve is removably fastened at the bottom end of the pogo-pin terminal. The conductive terminal is disposed within the conductive terminal slot. A receiving pedestal is used to seal the bottom end of the pogo-pin terminal slot. In accordance with the configuration of the insulative sleeve, an arcing effect occurring between the pogo-pin connector and a complementary connector can be avoided.

4 Claims, 4 Drawing Sheets

POGO-PIN CONNECTOR

FIELD OF THE INVENTION

The present invention relates to a connector, and especially to a pogo-pin connector which is utilized to prevent its pogo-pin terminals from being burnt under an arcing effect.

BACKGROUND OF THE INVENTION

As shown in FIG. 4, a pogo-pin connector 100' includes an insulated body 10', a plurality of pogo-pin terminals 20', a plurality of conductive terminals 30', a containing pedestal 40', and a spring part 50'. A plurality of pogo-pin terminal slots 11' and a plurality of conductive terminal slots 12' are defined on the insulated body 10'. The plurality of pogo-pin terminals 20' are disposed into the respective pogo-pin terminal slots 11' of the insulated body 10', in addition, each of which has a tip movably protruded out of the corresponding pogo-pin terminal slot 11'. The conductive terminals 30' each having a contacting portion 31' are disposed within the conductive terminal slots 12'. The contacting portion 31' is flexibly inserted into the corresponding pogo-pin terminal slot 11' of the insulated body 10' to abut against the pogo-pin terminal 20' therein. The receiving pedestal 40' blocks a bottom of the pogo-pin terminal slot 11'. The spring part 50' is received within the corresponding pogo-pin terminal slot 11', and has a top and bottom which are respectively abutted against the pogo-pin terminal 20' and the receiving pedestal 40'. Before a complementary connector is inserted therein, the conductive terminals 30' and the pogo-pin terminals 20' are conductively connected to each other.

However, when the complementary connector is inserted into the conventional pogo-pin connector, the complementary connector contacts a carrying-current conductor of the pogo-pin connector 100' to spark due to an arcing effect therebetween. This might invoke the pogo-pin terminal 20' charred and burnt.

SUMMARY OF THE INVENTION

To overcome the drawbacks of the aforementioned prior arts, an objective of the present invention is to provide a pogo-pin connector with a capability of preventing burning the pogo-pin terminals.

To achieve the foregoing objective, the present invention provides a pogo-pin connector which includes an insulated body, a plurality of pogo-pin terminals, an insulative sleeve, a plurality of conductive terminals, a plurality of receiving pedestals, and a plurality of spring parts. The insulated body has a plurality of pogo-pin terminal slots and a plurality of conductive terminal slots defined thereon. The plurality of pogo-pin terminals are respectively disposed within the pogo-pin terminal slots of the insulated body, wherein each of the pogo-pin terminals has a top end movably protruded beyond the corresponding pogo-pin terminal slot, and a bottom end defining a slotted hole toward an inside of the pogo-pin terminal. A stage is convexly disposed near and peripheral to the bottom end of each of the pogo-pin terminals. An insulative sleeve for accommodating within the corresponding pogo-pin terminal slot is removably fastened at the bottom end of each of the pogo-pin terminals. The conductive terminals are respectively disposed within the conductive terminal slots, wherein each of the conductive terminals has a contacting portion which is flexibly inserted into the corresponding pogo-pin terminal slot of the insulated body to abut against the stage or the insulative sleeve therein. A receiving pedestal is used to seal the bottom end of each of the pogo-pin terminal slots. The spring parts are used to be respectively disposed within the pogo-pin terminal slots, each in which a top end is abutted against the corresponding pogo-pin terminal, and a bottom end is abutted against the corresponding receiving pedestal.

As mentioned above, in accordance to the pogo-pin connector of the present invention, the contacting portion of each of the conductive terminals can be flexibly inserted into the corresponding pogo-pin terminal slot of the insulated body and thereby abut against the stage of the corresponding pogo-pin terminal and the insulative sleeve therein. When all of the pogo-pin terminals of the pogo-pin connector are pressed down to a predetermined position, conductions among all of the pogo-pin terminals and the corresponding conductive terminals can be realized so as to prevent the arcing effect occurring between the pogo-pin connector and its complementary connector.

DETAILED DESCRIPTION OF THE PREFERRED EMBODIMENTS

Reference will now be made in detail to a preferred embodiment of the invention, examples of which are illustrated in the accompanying drawings.

Figure 1:
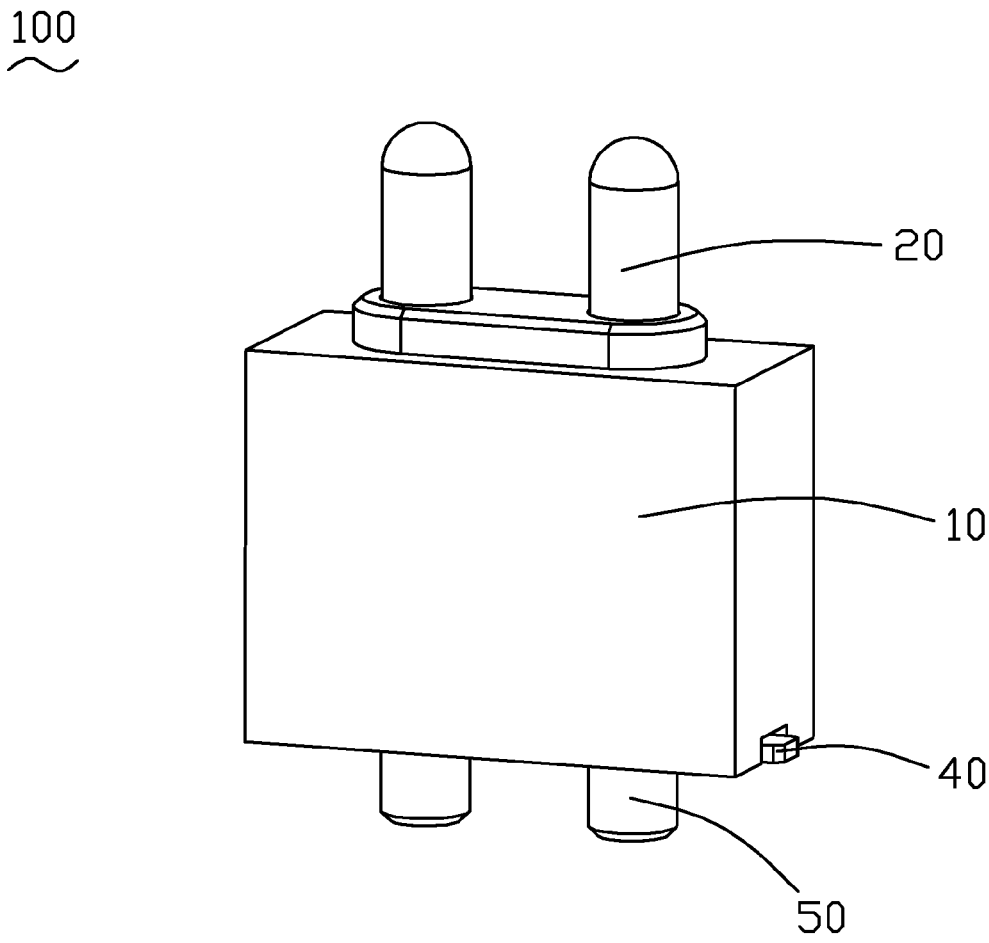
FIG. 1 is a perspective view illustrating a pogo-pin connector according to the present invention.
Figure 2:
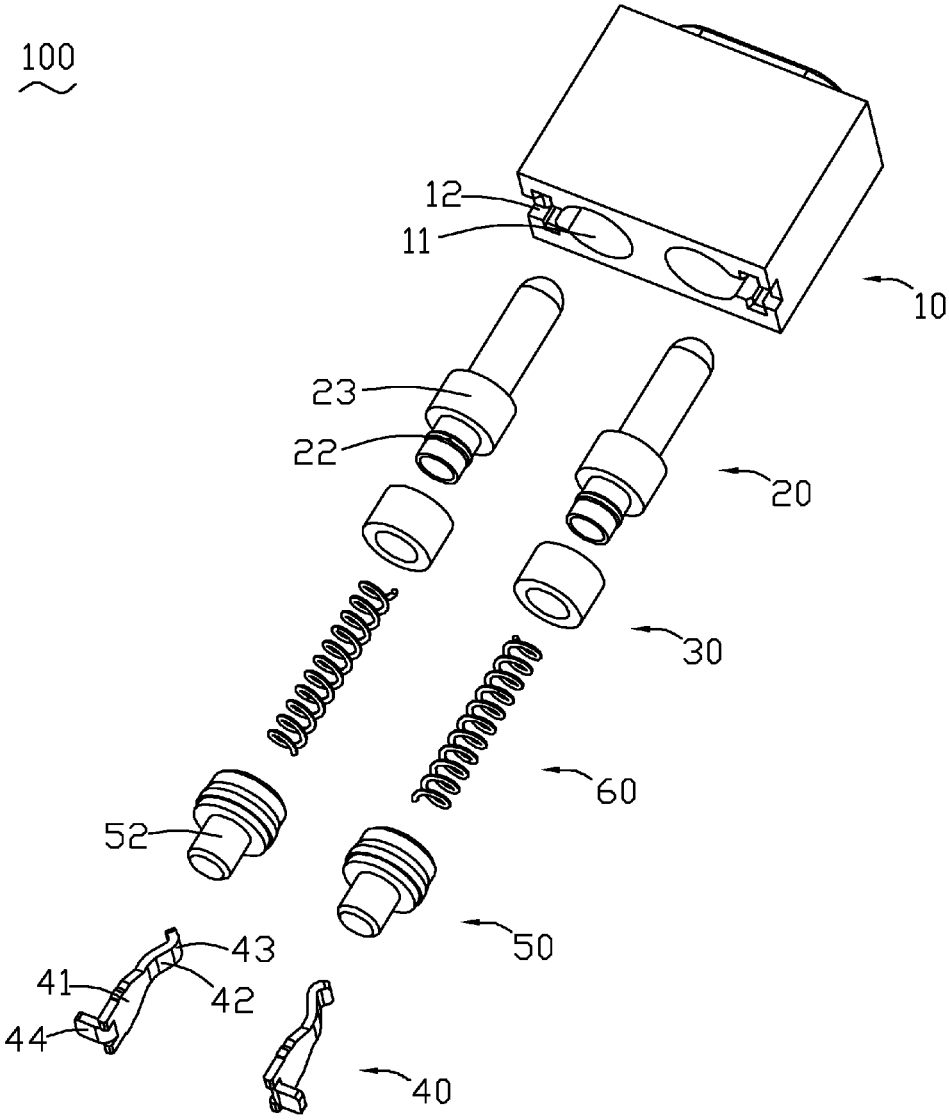
FIG. 2 is an exploded view illustrating the pogo-pin connector of FIG. 1.
Figure 3:
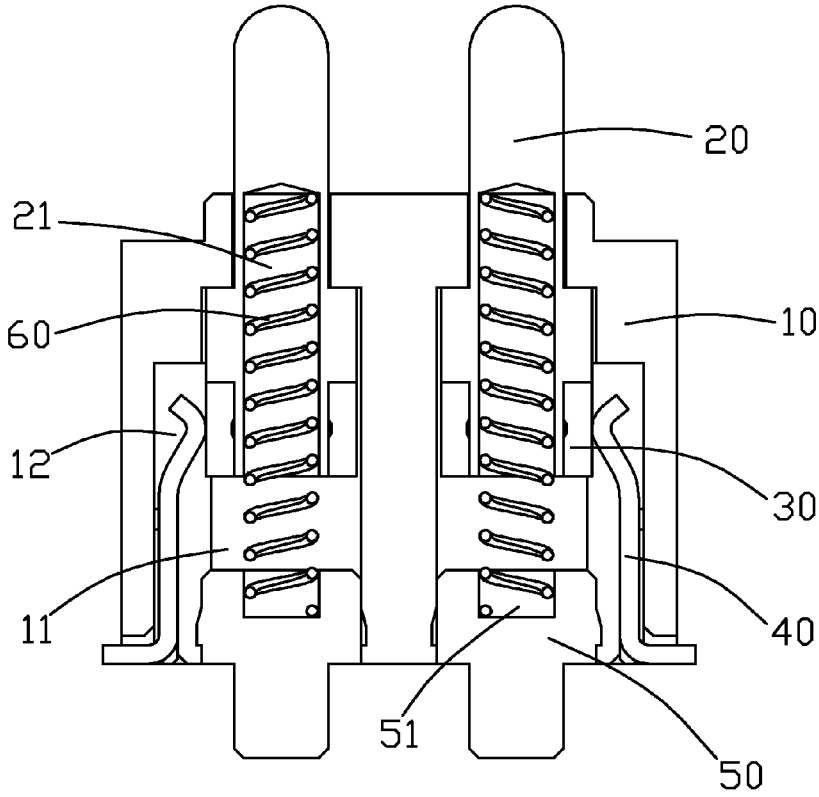
FIG. 3 is a cross-sectional view illustrating the pogo-pin connector of FIG. 1.
Figure 4:
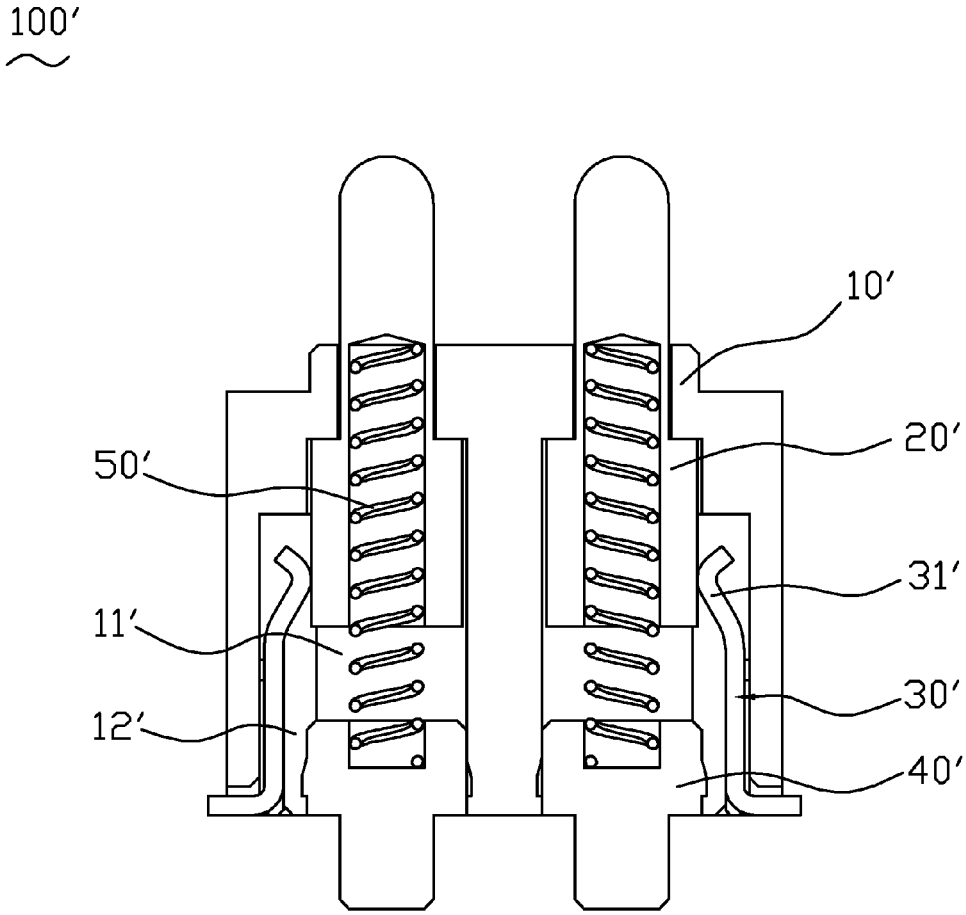
FIG. 4(Prior Art)
FIG. 4 is a cross-sectional view illustrating a conventional pogo-pin connector.

Referring to FIGS. 1 2 and 3, a pogo-pin connector 100 according to the present invention includes an insulated body 10, a plurality of pogo-pin terminals 20, a plurality of insulative sleeves 30, a plurality of conductive terminals 40, a plurality of receiving pedestals 50 and a plurality of spring parts 60.

The insulated body 10 has a plurality of pogo-pin terminal slots 11 vertically defined through the insulated body 10, and a plurality of conductive terminal slots 12 respectively communicated with the pogo-pin terminal slots 11 and defined upwardly on two sides of a bottom wall of the insulated body 10.

The pogo-pin terminals 20 shaped in cylinder-like are respectively disposed within the pogo-pin terminal slots 11 of the insulated body 10, wherein each of the pogo-pin terminals 20 has a top end movably protruded beyond the corresponding pogo-pin terminal slot 11, and a bottom end defining a slotted hole 21 toward an inside of the corresponding pogo-pin terminal 20. A ring protrusion 22 is convexly disposed near and peripheral to the bottom end of each of the pogo-pin terminals 20, and a stage 23 is convexly disposed above the ring protrusion 22 and peripheral to the corresponding pogo-pin terminal 20.

The insulative sleeves 30 are removably fastened at the bottom ends of the pogo-pin terminals 20 and accommodated within the pogo-pin terminal slots 11. Substantively, the insulative sleeve 30 is recessed to define a groove (not shown) inwardly thereto and correspondingly to radial directions of the ring protrusion 22 so that the ring protrusion 22 can engages with the groove.

The conductive terminals 40 are respectively disposed within the conductive terminal slots 12, and each of the conductive terminals 40 comprises a platy holding portion 41, an elastic arm portion 42 formed by extending upwards and inwards from an upper end of the holding portion 41, a contacting portion 43 formed by extending and bending from an end of the elastic arm portion 42 and a welding portion 44 formed by extending outwards and bending from a lower end of the holding portion 41. The holding portions 41 of the conductive terminals 40 are respectively disposed within the conductive terminal slots 12. The contacting portions 43 are flexibly inserted into the pogo-pin terminal slots 11 of the insulated body 10 to abut against the stages 23 or the insulative sleeves 30 therein. The welding portions 44 are welded on an external circuit board (not shown).

Each of the receiving pedestals 50 is used to seal at a bottom end of the corresponding pogo-pin terminal slot 11 and has a cylindrical receiving recess 51 and a plug portion 52 which seals one end of the receiving recess 51. Specifically, the receiving recesses 51 are used to seal the bottom ends of the pogo-pin terminal slots 11, and the plug portions 52 protrude out of the bottom ends of the pogo-pin terminal slots 11.

The spring parts 60 used for respectively accommodating within the pogo-pin terminal slots 11, each has a top end which is inserted into and abutted against a top wall of the corresponding slotted hole 21, and a bottom end which is inserted into and abutted against the receiving recess 51 of the corresponding receiving pedestal 50.

The operation principle of the pogo-pin connector 100 according to the present invention is as follows.

When the contacting portions 43 of the conductive terminals 40 respectively abut against the insulative sleeves 30 before the pogo-pin terminals 20 are pressed down or pressed to a predetermined position, the pogo-pin terminals 20 and the conductive terminals 40 are not conductive with each other.

When the pogo-pin terminals 20 are pressed down to the predetermined position and thereby compress the spring parts 60 to move downwardly, the contacting portions 43 of the conductive terminals 40 and the stages 23 of the pogo-pin terminals 20 are conductive with each other as well as conducting the pogo-pin terminals 20 and the conductive terminals 40.

If some operating mistakes occur while pressing the pogo-pin terminals 20, a single one of the pogo-pin terminals 20 may move down first during the beginning of pressing the pogo-pin terminals 20. However, the contacting portion 43 still abuts against the corresponding insulative sleeve 30 when the single pogo-pin terminal 20 is pressed but not to the predetermined position so that the pogo-pin terminal 20 and the corresponding conductive terminal 40 can not be conducted with each other. The contacting portion 43 abuts against the stage 23 only when the single pogo-pin terminal 20 is pressed to the predetermined position so that the pogo-pin terminal 20 and the corresponding conductive terminal 40 are conducted with each other. Meanwhile, all of the pogo-pin terminals 20 of the pogo-pin connector 100 are pressed down to the predetermined position so that all of the pogo-pin terminals 20 are conductive to the corresponding conductive terminals 40.

In summary, in accordance with the pogo-pin connector 100 of the present invention, the contacting portions 43 of the conductive terminals 40 can be flexibly inserted into the pogo-pin terminal slots 11 of the insulated body 10 to abut against the stages 23 of the pogo-pin terminals 20 and the insulative sleeves 30 therein. When all of the pogo-pin terminals 20 of the pogo-pin connector 100 are pressed down to the predetermined positions, conductions among all the pogo-pin terminals 20 and the corresponding conductive terminals 40 can be realized to prevent the arcing effect occurring between the pogo-pin connector 100 and the complementary connector.

What is claimed is:

1. A pogo-pin connector comprising:

an insulated body defining a pogo-pin terminal slot and a conductive terminal slot;

at least one pogo-pin terminal disposed within the pogo-pin terminal slot of the insulated body, each having a top end movably protruded beyond the pogo-pin terminal slot, and a bottom end defining a slotted hole toward an inside of the pogo-pin terminal;

an insulative sleeve removably fastened on the bottom end of the pogo-pin terminal and accommodated within the pogo-pin terminal slot;

at least one conductive terminal disposed within the conductive terminal slot, each having a contacting portion which is flexibly inserted into the pogo-pin terminal slot to abut against a side of the pogo-pin terminal or the insulative sleeve;

a receiving pedestal sealing a bottom end of the pogo-pin terminal slot; and a spring part accommodated within the pogo-pin terminal slot, having a top end abutted against the pogo-pin terminal and a bottom end abutted against the receiving pedestal.

2. The pogo-pin connector of claim 1, wherein the pogo-pin terminal further includes a ring protrusion convexly disposed near and peripheral to the bottom end of the pogo-pin terminal, a stage convexly disposed above the ring protrusion and peripheral to the pogo-pin terminal so that the contacting portion of the conductive terminal abuts against the stage, and the insulative sleeve further includes a groove defined inwardly thereto and correspondingly to radial directions of the ring protrusion so that the ring protrusion engages with the groove.

3. The pogo-pin connector of claim 1, wherein the receiving pedestal includes a cylindrical receiving recess and a plug portion for sealing one end of the receiving recess, wherein the bottom end of the pogo-pin terminal slot is sealed by the receiving recess, and the plug portion protrudes out of the bottom end of the pogo-pin terminal slot, and the spring part accommodated within the pogo-pin terminal slot has a top end inserted into and abutted against a top wall of the slotted hole and a bottom end inserted into and abutted against the receiving recess of the receiving pedestal.

4. The pogo-pin connector of claim 1, wherein the conductive terminal disposed within the conductive terminal slot comprises a platy holding portion, an elastic arm portion formed by extending upwards and inwards from an upper end of the holding portion, a contacting portion formed by extending and bending from an end of the elastic arm portion and a welding portion formed by extending outwards and bending from a lower end of the holding portion, wherein the holding portion of the conductive terminal is disposed within the conductive terminal slot.

* * * * *